US008007347B1

(12) United States Patent
Lampka et al.

(10) Patent No.: US 8,007,347 B1
(45) Date of Patent: Aug. 30, 2011

(54) ROTARY ABRADING TOOL

(75) Inventors: Mark Lampka, East Amherst, NY (US); Matthew Giles, Amherst, NY (US)

(73) Assignee: Dynabrade, Inc., Clarence, NY (US)

( * ) Notice: Subject to any disclaimer, the term of this patent is extended or adjusted under 35 U.S.C. 154(b) by 257 days.

(21) Appl. No.: 11/588,631

(22) Filed: Oct. 27, 2006

(51) Int. Cl.
*B24B 23/02* (2006.01)
*B24B 27/08* (2006.01)

(52) U.S. Cl. ..... 451/358; 451/541; 451/547

(58) Field of Classification Search ..... 451/358, 451/542, 541, 548, 207, 293, 395, 547
See application file for complete search history.

(56) References Cited

U.S. PATENT DOCUMENTS

| | | | | | |
|---|---|---|---|---|---|
| 792,050 | A | * | 6/1905 | King | 451/547 |
| 2,049,874 | A | * | 8/1936 | Sherk | 451/547 |
| 2,123,339 | A | | 7/1938 | Misuraca | |
| 2,416,785 | A | | 3/1947 | Welch | |
| 2,755,601 | A | * | 7/1956 | Lux | 451/178 |
| 2,776,529 | A | * | 1/1957 | Osplack | 451/47 |
| 3,079,741 | A | * | 3/1963 | Render | 451/49 |
| 3,251,086 | A | | 5/1966 | Springer | |
| 3,368,263 | A | * | 2/1968 | Harris, Jr. | 29/893.31 |
| 3,623,275 | A | * | 11/1971 | Koella | 451/541 |
| 3,683,566 | A | | 8/1972 | Walters | |
| 3,916,579 | A | * | 11/1975 | Waller et al. | 451/547 |
| 4,334,563 | A | * | 6/1982 | Epel et al. | 30/308.1 |
| 4,617,761 | A | * | 10/1986 | Miyatake et al. | 451/219 |
| 4,631,869 | A | * | 12/1986 | Miyatake et al. | 451/11 |
| 4,754,551 | A | * | 7/1988 | Scott | 33/543 |
| 4,774,788 | A | * | 10/1988 | Shacham et al. | 451/342 |
| 5,259,914 | A | | 11/1993 | Fisher | |
| 5,284,039 | A | | 2/1994 | Torgerson | |
| 5,338,134 | A | * | 8/1994 | Peng | 407/26 |
| 5,382,172 | A | * | 1/1995 | Klier et al. | 439/164 |
| 5,535,484 | A | * | 7/1996 | Gibson | 16/430 |
| 5,856,396 | A | | 1/1999 | Vipperman | |
| 5,879,504 | A | | 3/1999 | Winter | |
| 6,083,345 | A | | 7/2000 | Frank | |
| D429,393 | S | | 8/2000 | Rief et al. | |
| 6,136,143 | A | | 10/2000 | Winter et al. | |
| 6,309,292 | B1 | * | 10/2001 | Montabaur et al. | 451/542 |
| 6,358,133 | B1 | * | 3/2002 | Cesena et al. | 451/450 |
| 6,481,307 | B1 | * | 11/2002 | Klingelnberg | 74/459.5 |
| 6,949,019 | B2 | | 9/2005 | Wentworth et al. | |
| D516,260 | S | | 2/2006 | Chen | |
| 7,144,315 | B1 | * | 12/2006 | Sun et al. | 451/541 |
| 7,695,353 | B2 | * | 4/2010 | Moroto et al. | 451/541 |
| 7,722,442 | B2 | * | 5/2010 | Jones | 451/192 |
| 2003/0143935 | A1 | * | 7/2003 | Huber | 451/357 |
| 2004/0063383 | A1 | * | 4/2004 | Hui | 446/454 |

FOREIGN PATENT DOCUMENTS

WO WO 92/06821 4/1992

* cited by examiner

*Primary Examiner* — Timothy V Eley
(74) *Attorney, Agent, or Firm* — Simpson & Simpson, PLLC

(57) ABSTRACT

The present invention relates to rotary abrading tools of the erasure-type. The invention includes a wheel assembly comprising an annular eraser wheel having an outer crown of radially directed teeth, a central core of an elastomeric material that radially expands during operation, and a pair of discoid hubs secured on opposite axial ends of the eraser wheel. The teeth of the eraser wheel are helically arranged.

15 Claims, 6 Drawing Sheets

ROTARY ABRADING TOOL

FIELD OF THE INVENTION

The present invention relates to rotary abrading tools. More particularly, the invention relates to rotary abrading tools of the erasure type.

BACKGROUND OF THE INVENTION

Rotary abrading tools of the erasure type are used to remove adhesive material, such as paint and decalcomania, from metal surfaces. The tools frequently include a rotary driven annular disc comprised of an elastomeric material, called an "eraser wheel." The eraser wheel is rotated at high speeds and pressed against adhesive material for removal. Eraser wheels of this type tend to become deformed over time and, consequently, lose their efficacy. Furthermore, pressing the circumferential surface of the rotating wheel to a target surface generates a significant amount of frictional heat. The heat may cause damage to the wheel and may cause the residue of the abraded adhesive material to bond with surface of the wheel.

U.S. Pat. No. 6,309,292 (Montabaur) discloses a rotary abrading tool of the erasure type, an object of which is to correct these problems. The Montabaur eraser wheel is an annular disc comprised of an elastomeric material and includes an outer crown of radially projecting teeth. Montabaur presumes an improved performance over prior eraser wheels based on having bendable, elastic teeth. As stated in the patent, it is further contemplated that the improved performance is due, in part, to a reduction in the required amount of pressure applied by the teeth and to the teeth during operation, when compared to that of prior eraser wheels. Montabaur further asserts that the gaps between the teeth produce an "air effect", which serves to mitigate the frictional heat generated by the abrading. The Montabaur eraser wheel is secured to a rotary abrading tool by means of a "holder". The holder comprises a first and second disc-shaped hub, each comprising a central opening, arranged on opposite axial sides of the eraser wheel. Each hub further comprises a plurality of axially directed ribs, which are inserted into axially directed slots defined by an inner annular crown of the eraser wheel. Montabaur shows each rib of the first hub oppositely disposed from, and in contact with, a rib from the second hub. This contact between oppositely disposed ribs presents a problem. When the wheel and holders are tightly secured to an abrading tool, as is necessary for operation, the tips of oppositely disposed members tend to gall and damage each other. The galling is further exacerbated during operation as the wheel is rotating at high speeds, and the assembly is pressed against a surface.

The rotary driven shaft of the rotary abrading tool extends through the central opening of each hub and the central axis of the eraser wheel. An annular chamber surrounding the shaft is defined by the shaft, the holders, and the inner wall of the annular eraser wheel. Montabaur asserts that this arrangement provides an "air cushion effect" when the tool is operating at high rotational speeds, wherein the outer crown of teeth are lifted uniformly from the holder and creates an annular gap between the eraser and disc holder. While Montabaur discloses an eraser wheel that maintains a uniform circular shape during operation, the uniformity is due in large part to the "air cushion effect" that uniformly lifts the outer crown from the holder. When the eraser wheel is applied to a target surface during operation, the annular gap and chamber provide little resistance against the opposing force of the pressure of a target surface against the eraser wheel. This results in the partial collapse of the eraser wheel during operation, and, consequently, the need to apply further pressure in order to compensate for the partial collapse. The lack of stability in the circular form of the rotating eraser wheel adversely affects the efficacy of the tool as the user is forced to determine the optimal applied pressure during operation, which, in turn, adversely affects the life of the wheel. The problem is compounded during operation if the user has to adjust the angle of the tool due to the demands of the target surface and/or adhesive material.

The teeth of the Montabaur eraser wheel have convergent flanks, that is, each tooth tapers toward its outer end. Abrading is effected as an edge of each tooth successively hits the target adhesive material at a high speed, thereby compromising the integrity of the adhesive material. Subsequently, a portion of the material is torn away from the underlying metal surface as the teeth drag across the compromised material. Each radially projecting tooth extends axially on the circumference of the wheel, such that each tooth is axially parallel to the other. During operation, the teeth carry flakes of the abraded adhesive material as they rotate in a circular path. Consequently, the flakes are often thrown off radially from the wheel as it rotates. As such, Montabaur teaches a shield on the rotary abrading tool for the protection of the user from the flakes.

Thus, there is a longfelt need for a rotary abrading tool assembly free from the drawbacks of the earlier tools used for erasure-type abrading. In particular, a tool of this type that provides an eraser wheel assembly that maintains a sturdy circular shape during operation, structures that mitigate damage to the components of the assembly, and includes an eraser wheel that reduces the amount of flakes projected toward the user during operation.

SUMMARY OF THE INVENTION

The subject invention comprises a rotary eraser tool assembly. The invention further comprises a wheel assembly. The wheel assembly includes an annular eraser wheel, comprised of an elastomeric material, mounted on a cylindrical core, also comprised of an elastomeric material. The core has a central through-bore and is mounted on and rotated by the spindle on a rotary tool. The wheel assembly may include a band of elastic material surrounding the circumference discoid core and frictionally engaging the inner wall of the annular wheel and the circumferential surface of the core. The wheel assembly further includes two discoid hubs which are positioned on opposite axial sides of the eraser wheel. The hubs include a central opening and axially directed members, the members being insertable in slots defined by the eraser wheel. Each inserted member may be positioned axially across from an inserted member of the other hub, and each may be separated from the other by a membrane formed from the material of the eraser wheel. The rotary driven shaft of the rotary tool extends through the central axis of the wheel assembly. The rotary driven shaft may comprise a spindle and a bolt. The teeth of the eraser wheel are helically arranged to provide a lateral "sweeping" of abraded residue and increased efficacy of the teeth over prior eraser wheels of this type.

During operation, the cylindrical core radially expands due to the radially-directed tensile stress on the core caused by the centripetal acceleration of the material in rotation. The radially expansion is substantially uniform and directly relates to the speed of the rotation. The frictional engagement of the core to the eraser wheel directly relates to the radius of the core. Hence, as the speed of rotation increases, the core radially expands, and the frictional engagement of the eraser wheel to the core increases. The increase in frictional engagement and uniform expansion during operation provide a sturdy and relatively constant circular shape of the rotating wheel and improved performance over other rotary abrading tools of this type.

One object of the subject invention is to provide a rotary abrading tool of the erasure-type that includes an eraser wheel assembly that maintains a sturdy circular shape during operation.

A second object of the invention is to provide a tool of this type that includes structures that mitigate damage to the components of the assembly.

A further object of the invention is to provide an eraser wheel having teeth that are structurally arranged to reduce the amount of flakes projected toward the user during operation.

These and other objects and features of the present invention will become readily apparent upon reading the following detailed description in view of the drawings.

BRIEF DESCRIPTION OF THE SEVERAL VIEWS OF THE DRAWINGS

The nature and mode of the operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical structural elements of the invention.

While the present invention is described with respect to what is presently considered to be the preferred embodiments, it is understood that the invention is not limited to the disclosed embodiments. The present invention is intended to cover various modifications and equivalent arrangements included within the spirit and scope of the appended claims.

Figure 1:
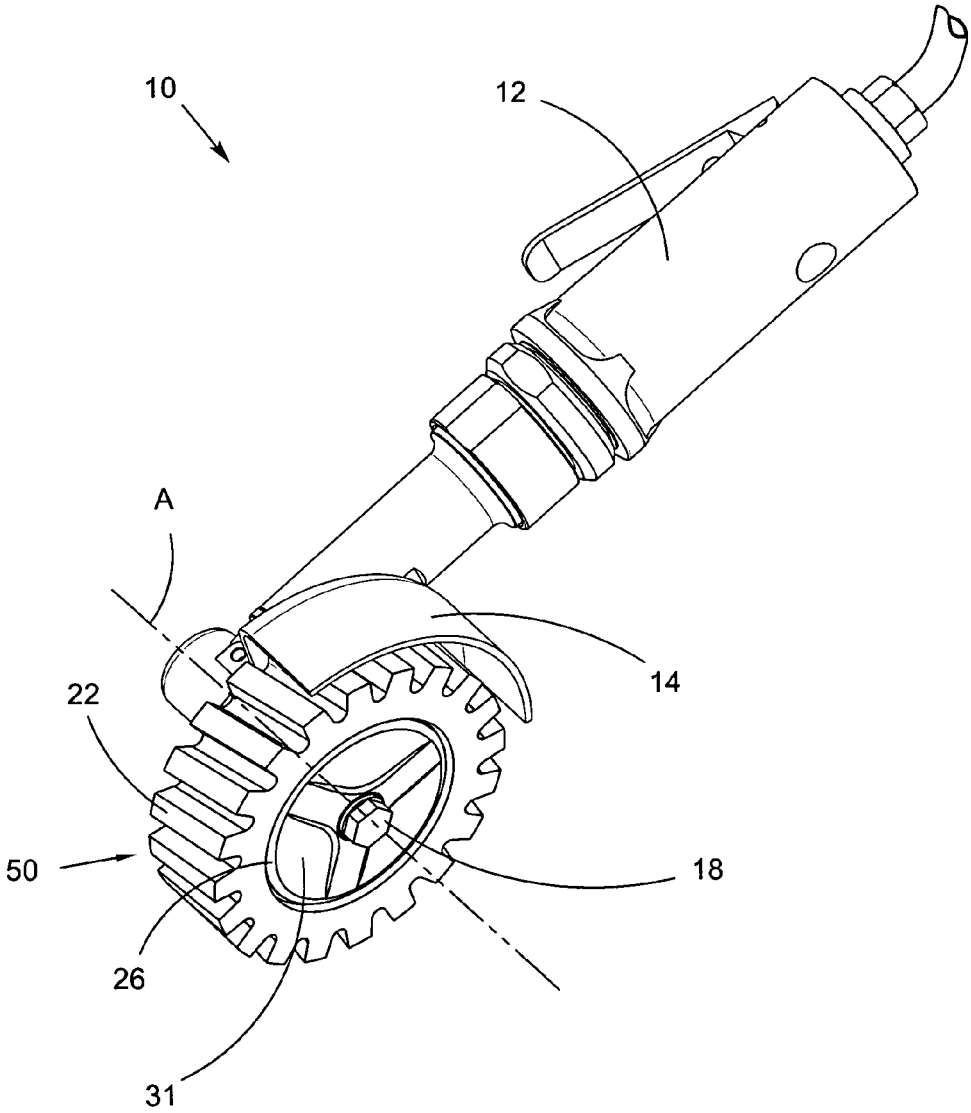
FIG. 1 is a perspective view of a rotary abrading tool assembly of the erasure-type.

Adverting to the drawings, FIG. 1 shows a perspective view of rotary abrading tool assembly 10 comprising rotary tool 12 and wheel assembly 50. Rotary tool 12 may be any rotary tool known in the art. Wheel assembly 50 is rotatably mounted on rotary tool 12 along central axis of rotation A. In one aspect of the invention, rotary tool 12 includes guard 14.

Figure 2:
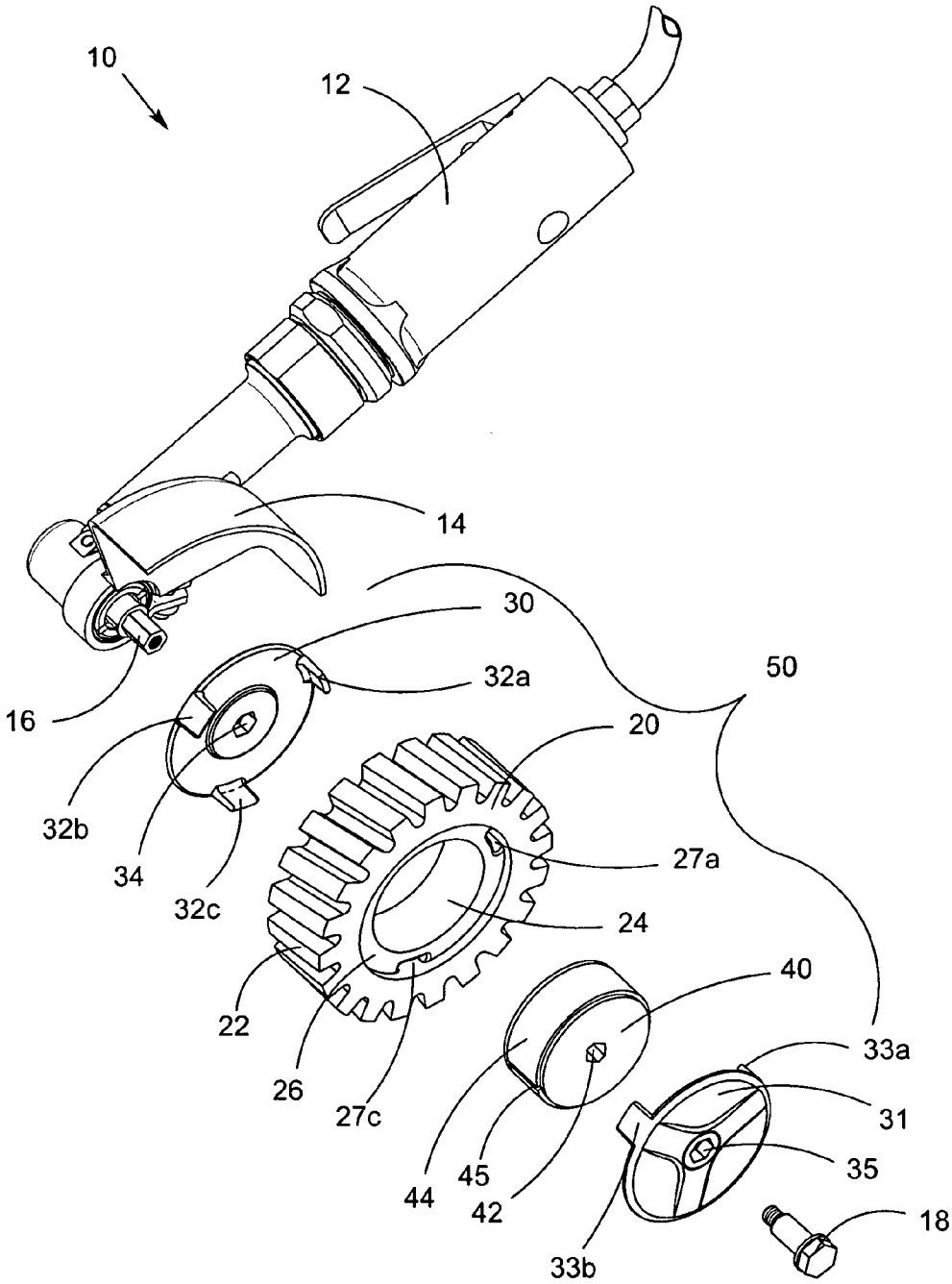
FIG. 2 is an exploded view of the rotary abrading tool.

FIG. 2 shows an exploded view rotary abrading tool 10 comprising rotary tool 12 and wheel assembly 50. In one embodiment of the invention, rotary tool 12 includes spindle 16. Wheel assembly 50 comprises annular eraser wheel 20, cylindrical core 40, and discoid hubs 30 and 31. Wheel assembly 50 may further comprise band 44. Bolt 18 secures wheel assembly 50 to tool 12 by coupling to spindle 16. It is contemplated that wheel assembly 50 may be mounted on rotary tool 12 along axis A by any means imaginable by one possessing skill in the art, for example, any rotary driven shaft common to rotary tools of this type.

Figure 3:
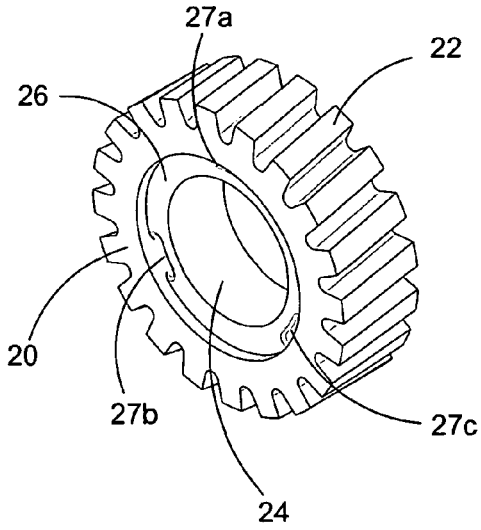
FIG. 3 is a perspective view of an eraser wheel for the rotary abrading tool.
Figure 4:
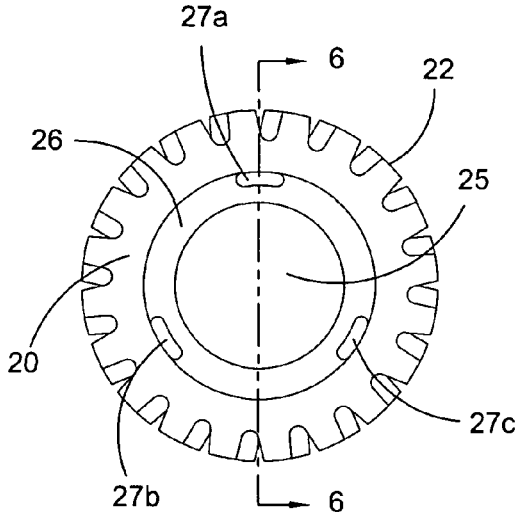
FIG. 4 is a plan view of the eraser wheel.
Figure 5:
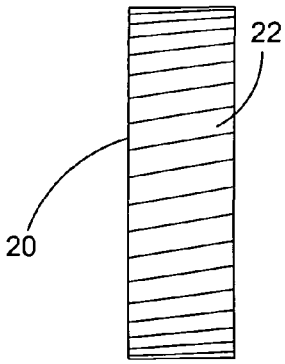
FIG. 5 is a side view of the eraser wheel.
Figure 6:
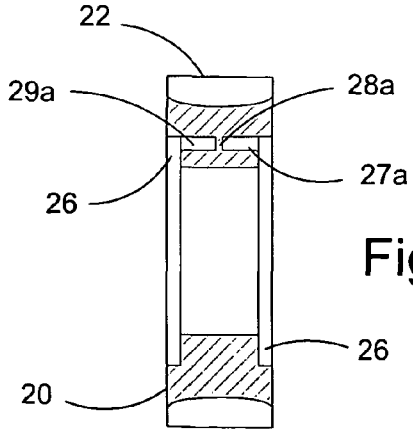
FIG. 6 is a cross-sectional view of the eraser wheel taken along line 6-6 in FIG. 4.

FIG. 3 shows a perspective view of eraser wheel 20. Eraser wheel 20 has an integral structure comprising an elastomeric material. Suitable elastomeric materials for the fabrication of eraser wheel 20 include R427/70-55 durometer shore A, made by Wacker Chemical Company, or equivalents. Eraser wheel 20 comprises inner annular recess 26, inner wall 24, and an outer crown of teeth 22 helically arranged about central axis of rotation A. Eraser wheel 20 defines central aperture 25 which is designed to receive core 40 as will be described below. The helical arrangement of teeth 22 is further depicted in FIG. 5, showing a side view of eraser wheel 20. FIG. 4 shows an axial side of eraser wheel 20 having a plurality axially directed slots 27*a-c* defined substantially by annular recess 26. Slots 27*a-c* may be angularly equispaced about axis A. Annular recess 26 further defines a plurality of slots 29*a-c* on both of its opposite axial sides (see FIG. 6 showing slot 29*a*). Slots 27*a-c* may be disposed directly opposite slots 29*a-c*, with respect to axis A. When disposed opposite each other with respect to axis A, slots 27*a-c* and 29*a-c* may terminate at membranes 28*a-c*, respectively. FIG. 6 shows wheel 20 cross-sected along line 6 of FIG. 4. As shown in the cross-sectional view, slots 27*a* and 29*a* are disposed opposite each other and terminate at membrane 28*a*. As will be described in more detail below, slots 27*a-c* and 29*a-c* are arranged to receive axially directed members 32*a-c* and 33*a-c*, respectively, of hubs 30 and 31.

Figure 7:
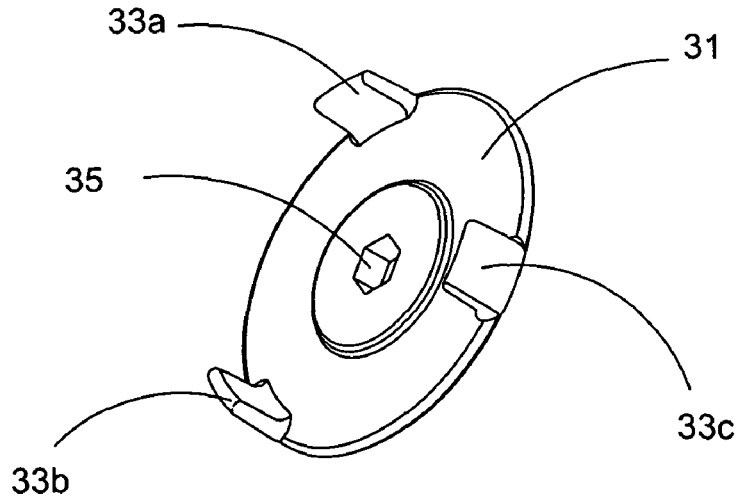
FIG. 7 is a perspective view of a single hub.
Figure 8:
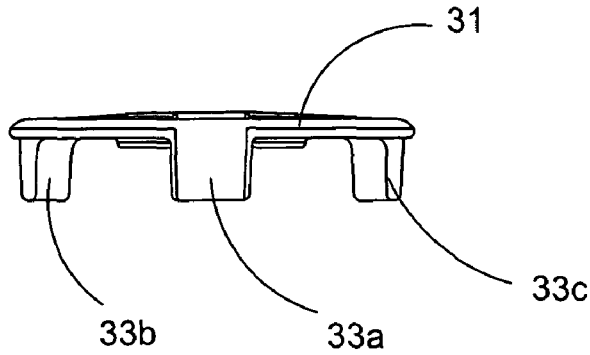
FIG. 8 is a side view of the hub showing three axially directed members.
Figure 9:
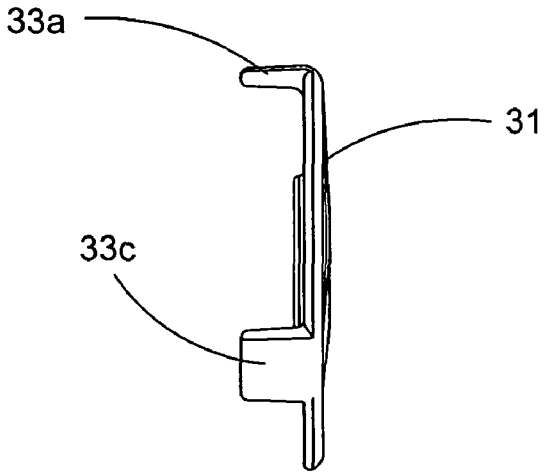
FIG. 9 is a side view of the hub showing two of the three axially directed members.

As stated above, wheel assembly 50 comprises discoid hubs 30 and 31. Hub 30 is substantially identical to hub 31, as each is designed to attach to either axial side of eraser wheel 20. FIG. 7 shows a perspective view of hub 31. Hub 31 defines central opening 35, which is designed to receive a rotary driven shaft of rotary tool 12, for example, spindle 16 coupled to bolt 18. Hubs 30 and 31 share axis A as their central axis when they are operably assembled in wheel assembly 50. Hubs 30 and 31 comprise members 32*a-c* and 33*a-c*, respectively. As shown in FIGS. 7-9, members 33*a-c* extend axially, with respect to axis A, and, as stated above, are arranged to be received by slots 29*a-c*. Similarly, member 32*a-c* are arranged to be received by slots 27*a-c*, respectively.

Figure 10:
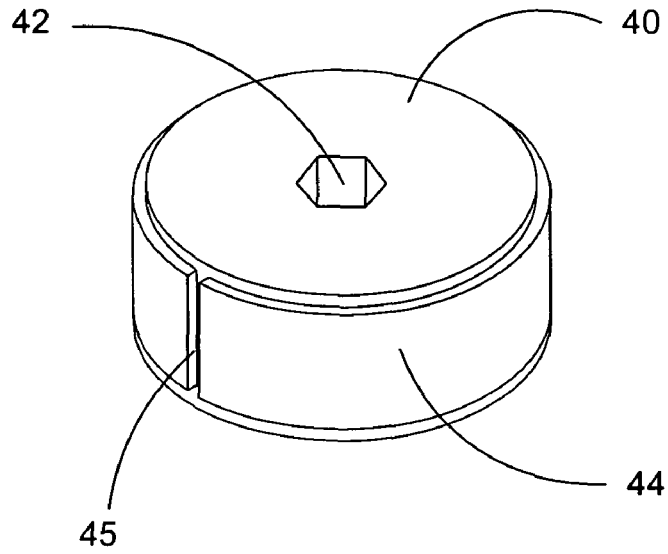
FIG. 10 is a perspective view of a cylindrical core having a band disposed partially about its circumference.
Figure 11:
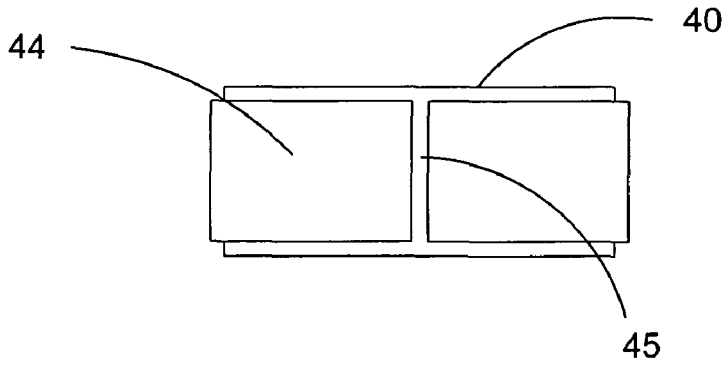
FIG. 11 is a side view of the core and band.
Figure 12:
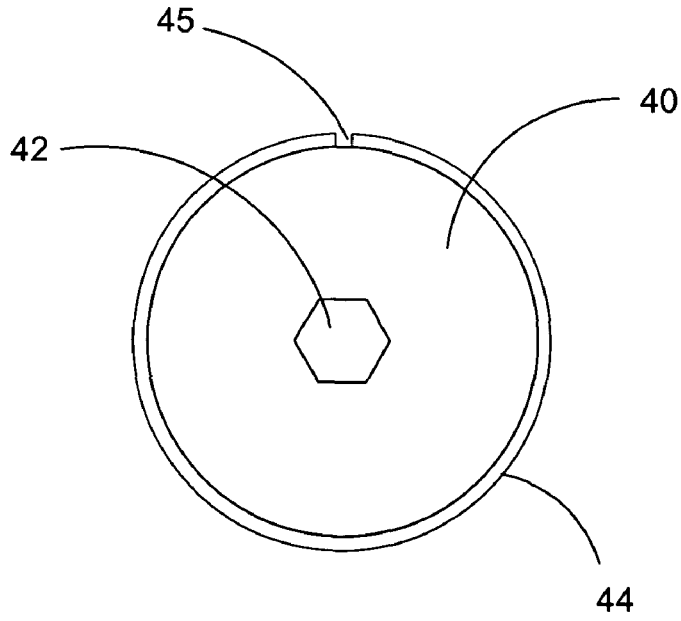
FIG. 12 is a plan view of the core and band.

FIG. 10 shows a perspective view of cylindrical core 40. Core 40 defines through-bore 42 disposed along its central axis. Through-bore 40 is designed to receive a rotary driven shaft of rotary tool 12, such as spindle 16 coupled to bolt 18. When assembled in wheel assembly 50, core 40 is disposed in aperture 25 of wheel 20 such that the circumferential surface of core 40 frictionally engages inner wall 24. Suitable materials for the fabrication of core 40 include urethane—60 durometer shore A, or equivalents. When wheel assembly 50 is rotated at high speeds, as when operating rotary tool assembly 10, core 40 radially expands due to the radially-directed tensile stress on the core caused by the centripetal acceleration of the material in rotation. The radial expansion is substantially uniform and directly relates to the speed of the rotation. The frictional engagement of core 40 to inner wall 24 directly relates to the radius of the core. Hence, as the speed of rotation increases, the frictional engagement of core 40 to inner wall 24 increases. The increase in frictional engagement and uniform expansion during operation provide a sturdy and relatively constant circular shape of wheel 20 during rotation and improved performance over other rotary abrading tools of this type. As stated above, band 44 may be included in wheel assembly 50. Band 44 is fabricated from an elastic material and substantially surrounds the circumferential surface of core 40. (see FIGS. 10-12) When assembled in wheel assembly 50, band 44 frictionally engages inner wall 24 and core 40. The inclusion of band 44 provides an advantageous torque effect due to the two-tier frictional engagement of the rotating components. In one aspect of the invention, band 44 is comprised of a metallic material. The use of a metallic material may have a positive effect on the frictional engagement needed to rotate assembly 50 at high speeds. In a further aspect of the invention, band 44 partially surrounds the circumference of core 40, thereby defining gap 45. Gap 45 may be beneficial if band 44 is fabricated from a metal that cannot expand sufficiently to accommodate the extent to which core 40 radially expands during operation.

Figure 13:
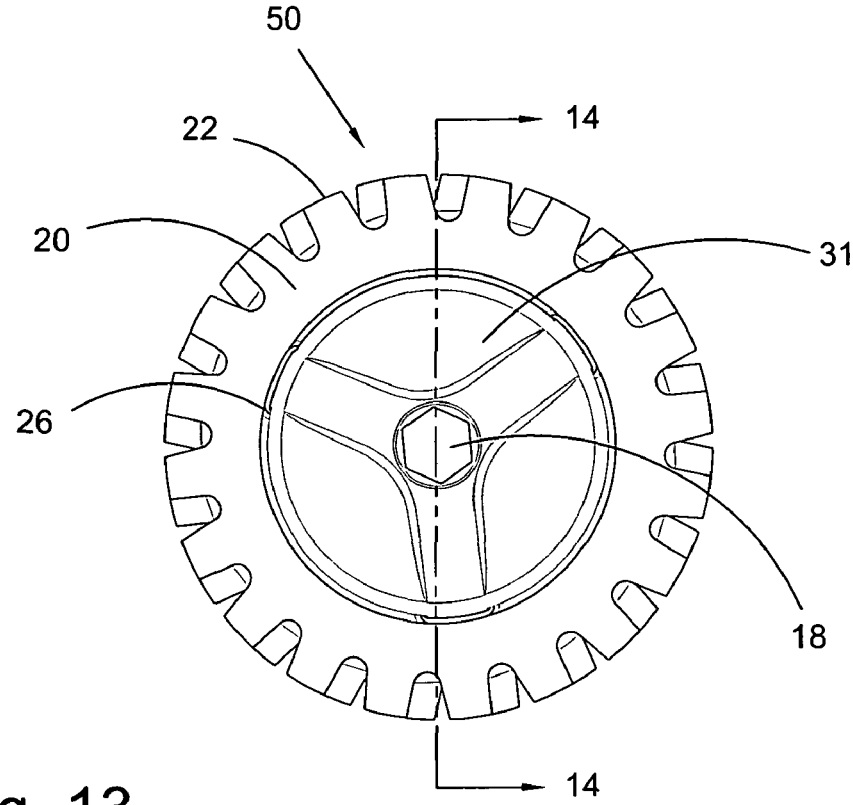
FIG. 13 is a plan view of an eraser wheel assembly.
Figure 14:
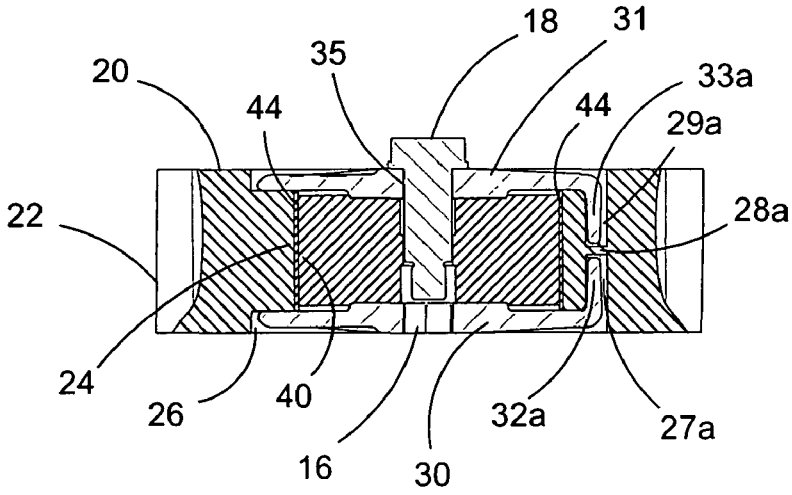
FIG. 14 is a cross-sectional view of the eraser wheel assembly taken along line 14-14 in FIG. 13.

FIG. 13 shows a plan view of wheel assembly 50. Bolt 18 is shown inserted through axis of rotation A of the assembly. FIG. 14 shows wheel assembly 50 of FIG. 13 cross-sected along line 14. In this drawing, assembly 50 comprises eraser wheel 20, core 40, band 44, and hubs 30 and 31. Bolt 18 is coupled to spindle 16 to secure wheel assembly 50 to tool 12 (see FIG. 2). Members 32*a* and 33*a* of hubs 30 and 31, respectively, are shown inserted into slots 27*a* and 29*a*, respectively, and separated by membrane 28*a*. While not shown in FIG. 14, it may be assumed that remaining members 32*b-c* and 33*b-c*, of hubs 30 and 31, respectively, are inserted into slots 27*b-c* and 29*b-c*, respectively. It may also be assumed that members 32*b-c* and 33*b-c* are oppositely disposed and separated by membranes 28*b-c*, respectively. By separating oppositely disposed members with membranes 28*a-c*, wheel assembly 50 can be tightly secured to and rotated by tool 12 without the tips of oppositely disposed members galling each other. When wheel assembly 50 is operatively secured to tool 12, hubs 30 and 31 frictionally engage opposite axial surfaces of core 40, such that when the rotary driven shaft of tool 12 is rotated at high speeds, the hubs and core act together to rotate eraser wheel 20. As eraser wheel 20 abrades a target material, the helical arrangement of teeth 22 provide a substantially lateral sweeping of the flakes of abraded material.

Thus it is seen that the objects of the invention are efficiently obtained, although changes and modifications to the invention should be readily apparent to those having ordinary skill in the art, which changes would not depart from the spirit and scope of the invention as claimed.

We claim:

1. A rotary abrading tool assembly, the assembly comprising:

a rotary abrading tool having a rotary driven shaft;

an annular wheel of an elastomeric material having a central axis of rotation, the wheel comprising:

an outer crown of radially projecting teeth, the teeth being helically arranged about the central axis of rotation;

an inner annular recess having a first and second axial side, the recess defining a plurality of axially extending slots on the first and second axial sides; and, a central aperture defined by the annular recess;

a cylindrical core of an elastomeric material, the core defining a through-bore along its central axis; and, a first and second discoid hub, each hub having a plurality of axially extending members, and each hub defining a central opening, wherein the core is arranged in the central aperture such that the central axis of the core is collinear with the central axis of rotation of the wheel, the circumferential surface of the core being in frictional engagement with the annular recess, wherein the first and second hubs are disposed on the first and second axial sides of the annular recess, respectively, such that the plurality of axially extending members of each hub are inserted in the plurality of axially extending slots, and wherein the central openings of the first and second hubs and the through-bore of the core are arranged to receive the rotary driven shaft.

2. The rotary abrading tool assembly of claim 1 further comprising a band of elastic material secured around the circumferential surface of the core such that the band is in frictional engagement with the core and the annular recess.

3. The rotary abrading tool assembly of claim 2 wherein the band incompletely surrounds the core such that the band defines a gap.

4. The rotary abrading tool of claim 2 wherein the elastic material comprises metal.

5. The rotary abrading tool assembly of claim 1 wherein the rotary driven shaft comprises a spindle and a bolt.

6. The rotary abrading tool of claim 1 wherein the plurality of axially direct slots on the first and second axial sides of the annular recess are angularly equispaced about the central axis of rotation.

7. The rotary abrading tool assembly of claim 6 wherein the plurality of slots on the first axial side of the recess are arranged axially opposite the plurality of slots on the second axial side of the recess.

8. The rotary abrading tool of claim 7 wherein the plurality of slots on the first axial side are separated from the plurality of slots on the second axial side by a plurality of membranes defined by the recess.

9. The rotary abrading tool of claim 1 wherein the core comprises urethane.

10. A wheel assembly for a rotary abrading tool comprising:

an annular wheel of an elastomeric material having a central axis of rotation, the wheel comprising:

an outer crown of radially projecting teeth, the teeth being helically arranged about the central axis of rotation;

an inner annular recess having a first and second axial side, the recess defining a plurality of axially extending slots on the first and second axial sides; and, a central aperture defined by the annular recess;

a cylindrical core of an elastomeric material, the core defining a through-bore along its central axis; and, a first and second discoid hub, each hub having a plurality of axially extending members, and each hub defining a central opening, wherein the core is arranged in the central aperture such that the central axis of the core is collinear with the central axis of rotation of the wheel, the circumferential surface of the core being in frictional engagement with the annular recess, wherein the first and second hubs are disposed on the first and second axial sides of the annular recess, respectively, such that the plurality of axially extending members of each hub are inserted in the plurality of axially extending slots, and wherein the central openings of the first and second hubs and the through-bore of the core are arranged to receive a rotary driven shaft of the rotary abrading tool.

11. The wheel assembly of claim 10 wherein the plurality of axially direct slots on the first and second axial sides of the annular recess are angularly equispaced about the central axis of rotation.

12. The rotary abrading tool assembly of claim 11 wherein the plurality of slots on the first axial side of the recess are arranged axially opposite the plurality of slots on the second axial side of the recess.

13. The rotary abrading tool of claim 12 wherein the plurality of slots on the first axial side are separated from the plurality of slots on the second axial side by a plurality of membranes defined by the recess.

14. The core of claim 10 wherein the elastomeric material is urethane.

15. The wheel assembly of claim 10 further comprising a band of elastic material secured around the circumferential surface of the core such that the band is in frictional engagement with the core and the annular recess.

* * * * *